United States Patent [19]

Reguant Soler

[11] Patent Number: 4,477,703

[45] Date of Patent: Oct. 16, 1984

[54] TRIPPING DEVICE FOR THERMAL RELAYS

[75] Inventor: Jaime Reguant Soler, Tarrasa, Spain

[73] Assignee: Agut, S.A., Tarrasa, Spain

[21] Appl. No.: 409,963

[22] Filed: Aug. 20, 1982

[30] Foreign Application Priority Data

Jun. 14, 1982 [ES] Spain ..... 265.804[U]

[51] Int. Cl.[3] ..... H01H 5/00; H01H 15/18

[52] U.S. Cl. ..... 200/76; 200/243; 200/67 B; 200/250

[58] Field of Search ..... 200/76, 67 B, 67 R, 200/250, 243

[56] References Cited

U.S. PATENT DOCUMENTS

| | | | |
|---|---|---|---|
| 1,635,634 | 7/1927 | Pohl | 200/76 X |
| 2,121,433 | 6/1938 | Kettunen | 200/67 B |
| 2,256,732 | 9/1941 | Brown | 200/67 B X |
| 2,596,893 | 5/1952 | Finizie | 200/67 B |
| 2,776,348 | 1/1957 | Korry | 200/76 |
| 3,290,463 | 12/1966 | Johnson | 200/67 A |
| 3,973,094 | 8/1976 | Kuhn | 200/67 PK |

FOREIGN PATENT DOCUMENTS

| | | | |
|---|---|---|---|
| 2030451 | 12/1971 | Fed. Rep. of Germany | 200/76 |
| 2031364 | 1/1972 | Fed. Rep. of Germany | 200/67 B |

*Primary Examiner*—Charles E. Phillips
*Assistant Examiner*—Ernest G. Cusick
*Attorney, Agent, or Firm*—Wenderoth, Lind & Ponack

[57] ABSTRACT

A device for tripping thermal relays includes a tilting fork controlled by a pusher which acts on a tension spring which connects a mid point of the fork to a fixed point of the casing of the device. The fork at its free movable end is joined to a contact-bearing sliding bar which is guided longitudinally and transversely. The bar is provided with dual breaker operating contacts which are continusouly biased by a spring to a closed position. The pressure exerted on the contacts is independent of the pressure exerted by the bar in its operative position or assembled with the contacts.

6 Claims, 1 Drawing Figure

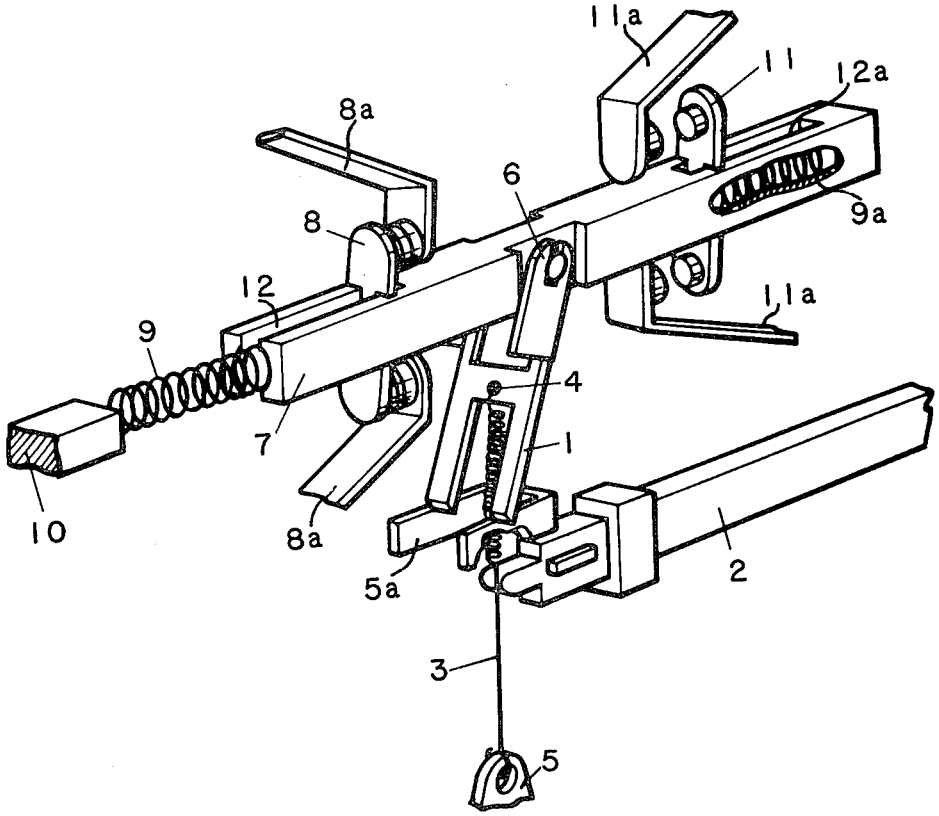
11a
11
12a
8a
6
9a
8
12
11a
9
4
7
1
10
8a
5a
2
3
5

TRIPPING DEVICE FOR THERMAL RELAYS

BACKGROUND OF THE INVENTION

The present invention relates to an improved tripping device for thermal relays, which is specially designed to maintain at all times a constant pressure over the electric contacts until they are tripped.

Basically there are two types of electric switches, that is trigger and rocker switches. The trigger type switches permit the contact pressure of the electric terminals to be maintained until they are tripped from the contact position to the inoperative position or vice versa. However, this type of switch cannot be adapted to automatic controls, so as to be operated by thermal relays and similar elements. Rocker type switches are suitable to be operated by means of automatic elements, but the contact pressure is not maintained constant, since as the rocker moves, the pressure between the electric terminals is gradually reduced until it reaches a point whereat the pressure is zero, from which point the switch is triggered. This gradual reduction in the pressure between the electric contacts causes serious heating problems in the terminals, as a result of which the application of this type switch is restricted to low-power equipment, since otherwise the heating results in risks and could cause serious accidents.

In view of the aforegoing, it is clear that it would be advantageous to have a switch which maintains the contact pressure constant and which can operate with automatic systems without any limitation in the power due to heating effects. The ideal solution to overcome the problem resides in a switch which combines the action of a rocker with a sliding strip or bar which bears the electric contacts, and this is precisely the solution offered by the present invention.

SUMMARY OF THE INVENTION

Thus, with the purpose of offering the market an advantageous, effective and definite solution, from a technical and commercial point of view, the tripping device of the invention is specially designed to solve above problems in a practical manner. The main and most outstanding characteristic of the device of the invention resides in the simplicity of its components which, together with the effectiveness of the system, convert it into a practical and competitive assembly from a technical and an economic-commercial point of view.

Hence, the present tripping device for thermal relays incorporates a tilting or pivotting fork which is controlled by a pusher which acts on a tension spring which connects a mid point of the fork to a fixed point of the casing of the device.

The fork has a free movable end which is capable of articulation and which is joined to a contactbearing sliding bar which is guided transversally and longitudinally. Such sliding bar is provided with normally closed operating electric contacts, which are of the dual breaker type and which are continuously biased to a closed position by a spring.

A free end of such spring rests on a fixed point of the apparatus, so that the pressure exerted on the contacts is independent of the pressure exerted by the sliding bar in its operative position or assembled with the electric contacts. The assembly also includes a normally open inoperative contact which is of the dual breaker type, which is independent of the normally closed contact and which is actuated opposite thereto.

BRIEF DESCRIPTION OF THE DRAWING

To conveniently illustrate the aforegoing, accompanying the present specification and forming an integral part thereof is a sheet of drawings schematically representing an illustrative and not limiting example of the invention, and wherein:

The single FIGURE is a prespective view illustrating the main elements of the tripping device of the invention.

DETAILED DESCRIPTION OF THE INVENTION

Referring to the drawing, there are shown therein a fork 1, a pusher 2, a tension spring 3, a mid point 4 of the fork, a fixed point 5 of a casing, a free moving end 6 of the fork, a contact bearing sliding bar 7, normally closed operating electric contacts 8, a spring 9, a fixed point 10 and normally operative electric contacts 11.

The tripping device is formed of fork or pivotable member 1 mounted to be tilted or pivotted and forming a rocker of the switch. Fork 1 is actuated by means of pusher 2 which is connected to a thermal relay or similar element.

The pusher 2 acts directly on the tension spring 3, causing the movement of the mid point 4 of the fork 1 since the lower end of the tension spring 3 is joined to the fixed point 5 of a casing for the device. The movement of the mid point 4 causes the fork 1 to pivot about its lower edge, e.g. with respect to a portion 5*a* of the casing, whereby free end 6 of fork 1 and thereby sliding bar 7 to move forward or backward.

The sliding bar 7 is guided longitudinally and transversely by means of portions (not shown) of the casing itself of the assembly. The movements of the sliding bar 7 determine the positions of the electric contacts 8 and 11. Movable contacts 8 and 11 each is in the form of a pair of contact elements supported on opposite ends of an electrically conductive bridge member.

In the position illustrated in the drawing, the fork 1 remains inclined towards the right due to the traction exerted by the spring 3, so that the bar 7 separates normally open contacts 11 from respective fixed contacts 11*a* and connects the normally closed contacts 8 with respective fixed contents 8*a*. Contacts 8 extend transversely through a longitudinal groove 12 formed in a respective end of bar 7 and are urged therein toward the fixed contacts 8*a* by spring 9, the opposite end of which abuts fixed point 10 of the casing. Similarly, contacts 11 extend transversely through a longitudinal blind groove 12*a* formed in the opposite end of bar 7 and are urged therein toward the fixed contacts 11*a* by a spring 9*a* compressed between contacts 11 and an end of groove 12*a*.

When the thermal relay exerts its action on the pusher 2, this produces the movement of the sliding bar 7 by means of the tension spring 3 and the fork 1, such that the initial path of tilting movement of the fork 1 takes place without affecting the conditions or states of the contacts 8 and 11, due to a space between the bottom of groove 12 and the contacts 8, and to the space which separates the contacts 11 from the fixed contacts 11*a*.

When the fork 1 is tilted such that mid point 4 moves beyond a position in alignment with the fixed point 5 and the tilting point of the bottom end of the fork 1, then fork 1 suddenly trips due to the traction exerted by the spring 3, thereby immediately causing the separation of the contacts 8 from contacts 8*a* and the connection of the contacts 11 with contacts 11*a*.

As discussed above and as represented in the drawing, the main advantage of the invention resides in achieving a rocker switch which closes and opens the respective contacts instantaneously, without a gradual loss in pressure over the surface of the contacts, thereby preventing the previously mentioned inconveniences and risks. The elements of the assembly of the invention are obtained from inexpensive materials which readily can be fabricated and the assembly of which is very simple and rapid, all contributing to reduce the cost of manufacture and labor and to construct a highly competitive and specially effective assembly.

I claim:

1. A snap action device for use in tripping a thermal relay, said device comprising:

a sliding bar mounted for movement in opposite longitudinal directions;

a pivotable member having a first end mounted for tilting movement at a fixed position and a second end articulated to said bar, such that tilting movement in opposite directions of said pivotable member at said first end thereof results in movement of said bar in respective said opposite longitudinal directions;

first and second fixed contacts positioned at respective positions spaced longitudinally of said bar;

first and second movable contacts mounted on said bar and movable therewith between a first longitudinal position of said bar, whereat said first movable contact is in contact with and closes said first fixed contact and said second movable contact is spaced from and opens said second fixed contact, and a second longitudinal position of said bar, whereat said first movable contact is spaced from and opens said first fixed contact and said second movable contact is in contact with and closes said second fixed contact;

means for urging said first and second movable contacts in directions toward said first and second fixed contacts, respectively;

means for biasing said pivotable member to pivot about said first end thereof in a first direction to move said bar to said first longitudinal position thereof, said biasing means comprising a tension spring having a first end connected to a mid portion of said pivotable member between said first and second ends thereof and a second end connected to a fixed position, said tension spring tilting said pivotable member in said first direction when said mid portion is spaced in said first direction from a rectilinear line between said second end of said tension spring and said first end of said pivotable member; and means for stretching said tension spring in a direction to cause said pivotable member to tilt in a second direction opposite to said first direction until said mid portion is spaced in said second direction from said rectilinear line, whereat said tension spring then undergoes snap action and biases said pivotable member about said first end thereof in said second direction to move said bar to said second longitudinal position thereof.

2. A device as claimed in claim 1, wherein said stretching means comprises a member, operable in response to a rise in temperature, to push against said tension spring at a position between said first and second ends thereof.

3. A device as claimed in claim 1, wherein said bar has in a first end thereof a longitudinally extending open ended first groove, said first movable contact is slidably mounted in said first groove, and said means for urging said first movable contact comprises a first spring acting between said first movable contact and a fixed position.

4. A device as claimed in claim 3, wherein said first spring comprises a compression spring compressed between said first movable contact and said fixed position.

5. A device as claimed in claim 3, wherein said bar has in a second end thereof a longitudinally extending blind second groove, said second movable contact is slidably mounted in said second groove, and said means for urging said second movable contact comprises a second spring acting between said second movable contact and a surface of said bar defining an end of said second groove.

6. A device as claimed in claim 5, wherein said second spring comprises a compression spring compressed between said second movable contact and said surface.

* * * * *